US005881840A

United States Patent [19]

Mize

[11] Patent Number: 5,881,840

[45] Date of Patent: Mar. 16, 1999

[54] OIL DEVIL-CRANKCASE OIL REMOVAL THROUGH DIPSTICK SYSTEM

[75] Inventor: Greg G. Mize, 2300 Deer Run Trail, Bronson, Iowa 51007-8049

[73] Assignee: Greg G. Mize, Bronson, Iowa

[21] Appl. No.: 886,716

[22] Filed: Jul. 1, 1997

[51] Int. Cl.[6] ..... F01M 11/04

[52] U.S. Cl. ..... 184/1.5

[58] Field of Search ..... 123/196 A, 196 R; 184/1.5

[56] References Cited

U.S. PATENT DOCUMENTS

| | | | |
|---|---|---|---|
| 2,175,624 | 10/1939 | Wood | 184/1.5 |
| 2,536,492 | 1/1951 | Dunn et al. | 184/1.5 |
| 3,335,817 | 8/1967 | Horning | 184/1.5 |
| 3,743,053 | 7/1973 | Kuklewiez | 184/1.5 |
| 3,773,091 | 11/1973 | Boyd et al. | 184/1.5 |
| 4,378,026 | 3/1983 | Bauer | 184/1.5 |
| 4,750,456 | 6/1988 | Ladrach | 123/196 S |
| 4,807,674 | 2/1989 | Sweet | 184/1.5 |
| 4,909,205 | 3/1990 | Bewley, III | 123/196 S |
| 5,044,469 | 9/1991 | Liu | 185/1.5 |
| 5,074,380 | 12/1991 | Bedi et al. | 184/1.5 |
| 5,148,785 | 9/1992 | Sendak | 123/196 R |

FOREIGN PATENT DOCUMENTS

| | | | |
|---|---|---|---|
| 28 16 666 | 10/1979 | Germany | 184/1.5 |

*Primary Examiner*—Erick R. Solis
*Attorney, Agent, or Firm*—Greg G. Mize

[57] ABSTRACT

An improved system of removing oil from an internal combustion engine serviced (130) oil pan or sump though an associated dipstick tube (120). This system uses the vacuum source from a second host internal combustion engine (100) through means of a vacuum conduit (24)connected to a reservoir (40) which draws the oil from the engine serviced (130) sump through the dipstick tube (120) by means of a hydraulic conduit (32) to the reservoir (40).

3 Claims, 7 Drawing Sheets

OIL DEVIL-CRANKCASE OIL REMOVAL THROUGH DIPSTICK SYSTEM

BACKGROUND

1. Field of Invention

This invention relates to internal combustion engine crankcase lubricant removal, specifically, but not limited to, marine inboard internal combustion engines, using a separate internal combustion engine as means of a vacuum source.

2. Description of Prior Art

An internal combustion engine that is mounted inside of a recreational boat is called a marine inboard engine. These engines are of the same basic design of automotive engines, some of the internal parts are retrofitted to accept the marine environment that boats and the inboard internal combustion engines are subject to.

When a 4, 6, or 8 cylinder, four cycle engine is mounted inside of a boat, the crankcase oil pan is set low in the boat hull. Due to the low center of gravity mounting of the engine in the boat hull, the drain plug is nearly impossible to use or if you can access the drain plug it is very messy when you drain the oil. The oil runs all through the inside of the boat hull. Due to the low engine mounting, you can not place a drain receptacle or pan under it. The spent oil is to drain out through the hull drain plug in the back of the boat. After a day of water activities on a lake, river, or ocean the boat is loaded on to a boat trailer. At this time as a normal practice of boating, the hull drain plug is removed to drain out any water that has penetrated the inside of the boat's hull. When this procedure is performed the oil film that has accumulated in the bottom of the boat hull from conventional oil removal servicing runs out on the ground or down the launching ramp and into the water. This is environmentally unacceptable.

To remedy this, marine inboard engine manufacturers have manufactured into the marine inboard engines dipstick tube that is used to check the oil level in the crankcase of the engine, a threaded male end of a garden hose type fitting on the top end of the tube itself, to remove the oil through the dipstick tube itself. The tube extends to the bottom of the crankcase oil pan to be used with the purpose of using some type of suction or siphon system to pull the oil up the tube for removal.

Prior arts try to take advantage of this oil removal system, such as U.S. Pat. No. 5,148,785 to Sendak (1992) and U.S. Pat. No. 5,044,469 to Liu (1991) using an electric 12 volt motor to pump the oil out of the crankcase through the dipstick tube. The Boat/US 1996 Annual Equipment Catalog, page 174, shows other prior arts using 110 volt electric drill to drive a handheld pump and another uses a slide pump similar to a bicycle tire pump. This pump is attached to a reservoir and creates a vacuum in a container to receive the spent oil. U.S. Pat. No. 3,743,053 (1973) to Kuklewicz has a 12 volt electric motorized pump. The electric motor is attached to the engine itself and the suction hose removes the oil from the oil pan by connecting a hose to the drain plug on the bottom of the pan. Nevertheless, all dipstick tube oil removal systems heretofore known suffer from a number of disadvantages:

(a) A hose connected to the bottom of the oil drain plug raises concern, the safety valve supplied by a prior art connected to the drain plug to which the hose is connected to can easily be turned. That is why manufacturers of automotive and marine internal combustion engines do not supply such valves, instead they equip the drain plugs with a threaded plug that requires a wrench to remove it, (they don't want the liability claims). The engine vibrating while in operation can cause either the hose to rub on any object(s) in the engine compartment and leaking oil out of the motor, or electrical wire rubbing on engine compartment object(s) causing a circuit to short out and start pumping out oil and not know it until it is too late and the engine seizes up.

(b) All of these prior arts have moving mechanical parts and seals. As a common fact any device that has moving parts will wear out at any given time. Most of these prior arts when purchased, have a parts list of seals and motor replacement parts to replace worn or damaged parts.

(c) Most vacuum oriented prior arts require close surveillance of the device while removing the oil and some require hands-on operation of the pump while in use, or manual manipulation of the pump while in use.

(d) Of these prior arts on average, the time span for drawing the oil from the crankcase takes from 3–10 minutes.

(e) When disconnecting the prior arts fittings from the dipstick tube, oil laying in the hose connected to the dipstick tube will run down the outside of the tube when removed from the tube, causing more of a mess to try to cleanup in the boat's hull.

(f) Marine internal combustion engines are equipped with special electrical wiring to eliminate a spark to minimize the risk of igniting gasoline vapors that reside in the engine compartment causing fatal or serious personal injury. Some prior arts use 12 volt electric motors with battery spring clamps connecting these motors to the batteries located in the engine compartment which may spark and cause an explosion.

OBJECTS AND ADVANTAGES

Accordingly, several objects or advantages of my invention are:

(a) to provide a low cost in manufacturing of my oil removal system, passing savings on to the consumer, and a high quality product that will last many years after any of the prior arts motors, parts, pumps, and seals have worn out;

(b) to provide the simplest way to change the crankcase oil lube in marine inboard internal combustion engines that anyone who owns a trailer boat can achieve. After the initial installation of the tee into the vacuum conduit in an automobile, it will only take two connections to achieve the task of changing oil in the inboard engine through the dipstick tube;

(c) to provide a cleaner way of servicing internal combustion engines that is environmentally friendly. When disconnecting the garden hose fitting from the dipstick tube, leave the automobile running and any traces of oil in the hose that tends to collect near the garden hose fitting will be drawn up into the hose to the reservoir container, (d) to provide a way to change oil in the internal combustion engine, without using any type of electric mechanical motors or physical labor hand pumps that have moving mechanical parts or seals to wear out. Using the vacuum from the engine of the automobile which you pull the trailer boat with, you already have the vacuum source to connect to;

(e) to provide a quick way to pull the oil out of the crankcase though the dipstick tube and into an enclosed reservoir in 1 minute or less. With internal combustion engines developing on average 22 inches Hg (inches Hg, a measurement of vacuum), providing a very strong, steady, and endless supply of a vacuum source;

(f) to provide a safe process of removing the crankcase oil from the engine inside of a confined space where gasoline vapors may exist and to avoid possible risk of an electrical spark that may cause an explosion;

(g) to provide a system of removing the oil from the crankcase through the dipstick tube with out any monitoring or surveillance during the operation of the oil removal, with the correct predetermined reservoir size the automobile can run all day connected to my oil removal system and it can continue to pull out oil that continues to drain down the inside of the oil sump pan that you are draining;

DRAWING FIGURES

In the drawings, closely related figures have the same FIG. number but different alphabetic suffixes.

REFERENCE NUMBERS IN DRAWINGS

Figure 1:
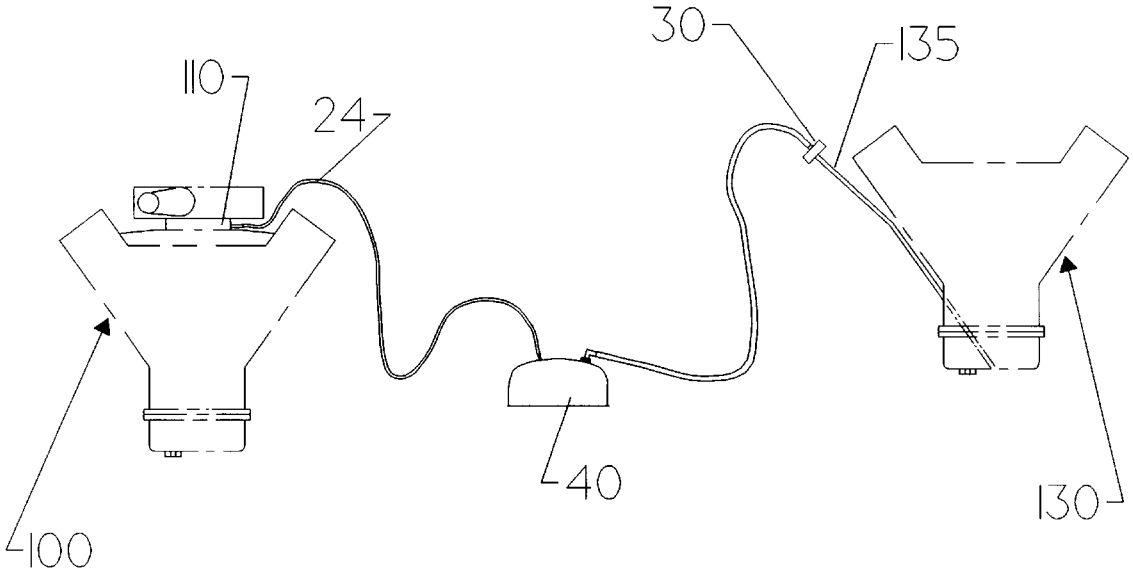
FIG. 1 shows the total aspect of the oil removal system, from engine serviced to host engine.

20 three way vacuum conduit connector
22 cap
24 vacuum conduit
24A splice
26 small two way vacuum connector
28 washer seal
30 garden hose style connector
32 hydraulic conduit
34 threaded reservoir lid
36 threaded opening
38 outlet
40 reservoir
44 inlet hole in washer
46 washer seal for 34
48 inlet
50 large grommet
52 large two way connector
54 small grommet
100 host engine
110 intake manifold of carburetor
115 actuator device of host engine
120 threaded dipstick tube
130 engine serviced
135 dipstick tube of engine serviced

Description—FIGS. 2 to 7C

Figure 2:
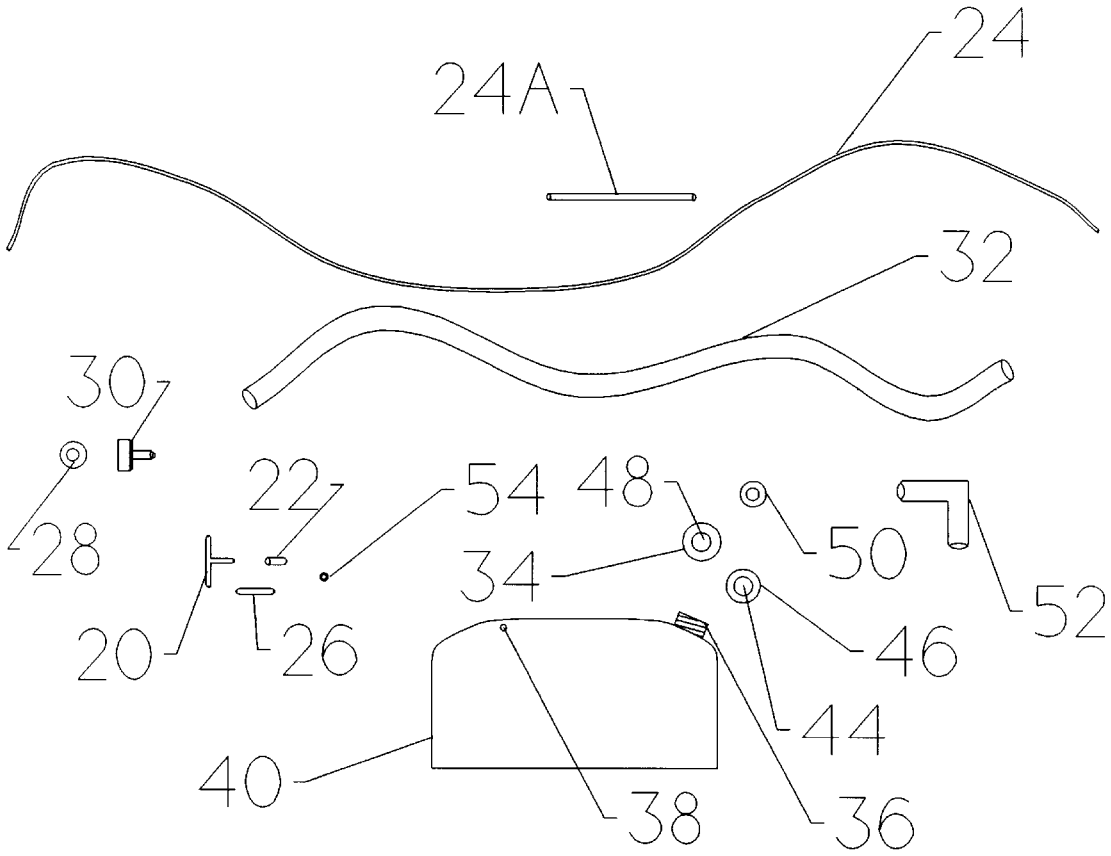
FIG. 2 shows an exploded view of all of the parts required for the oil removal system.

A typical embodiment of the oil retrieval system in an exploded view is illustrated in FIG. 2. The parts in this system may and can vary, but the sizes of the parts that have been chosen for this illustration are best suited for the oil retrieval system. It is configured to suit the automotive industries' standards for vacuum lines to withstand 22 Hg inches of vacuum. The automotive industry uses as a standard 3/16 inch inside diameter vacuum conduit, and 3/16 inch outside diameter hose connectors, and actuator devices.

In FIG. 2 the metal oil reservoir 40, can be capacity of 1 quart to 10 gallons. A 10 quart size is used for the illustrations due to a common crank case capacity of internal combustion engines which are 5 to 6 quarts. In FIGS. 1 and 2 a rubber vacuum conduit 24 can also vary in size, the best size is the same as what auto manufacturers use, this being 3/16" inside diameter, and a length depending on the application use and distance of the automobile in relation to the distance of the inboard engine. Length will not impede operation of the system. A hollow plastic or metal three way vacuum conduit connector 20 must be the same size as auto manufacturers use, which is 3/16" outside diameter. A cap 22 is to be 3/16" I.D. A hollow plastic or metal small two way vacuum connector 26 must be the same size as auto manufacturers use, which is 3/16" outside diameter. A small rubber grommet 54 I.D. must be 3/16" in size to receive small two way vacuum connector 26 and is to fit inside of a 3/8" outlet 38 in reservoir 40. A plastic or metal garden hose threaded style female connector 30 with a hollow ½" O.D. fitting on other end. A plastic or rubber washer seal 28 is the same as used in standard female threaded garden hose fitting. A rubber hydraulic conduit 32 ½" I.D. and 5' in length and oil resistant and resist collapsing with 22 Hg inches of vacuum. A plastic or metal large two way connector 52 is to be ½" O.D. at both ends. A large rubber grommet 50 has ½" I.D. hole to receive elbow 52, and is to fit in to 1' hole 48. A threaded inlet 36 to match lid cover 34. Plastic or rubber washer seal 46 to fit into threaded reservoir lid 34 with a 1' hole 44.

Assembly FIGS. 3A to 7C

Figure 3A:
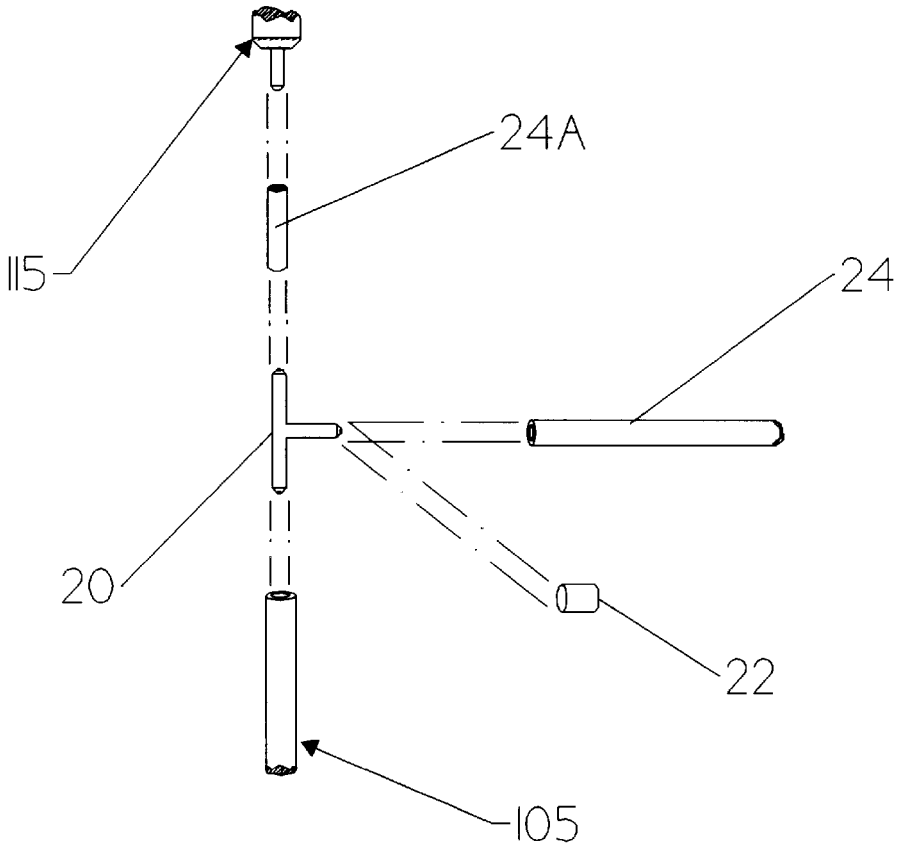
FIG. 3A shows the exploded view of the modification to make at the host engine for the connection of the vacuum source.
Figure 3B:
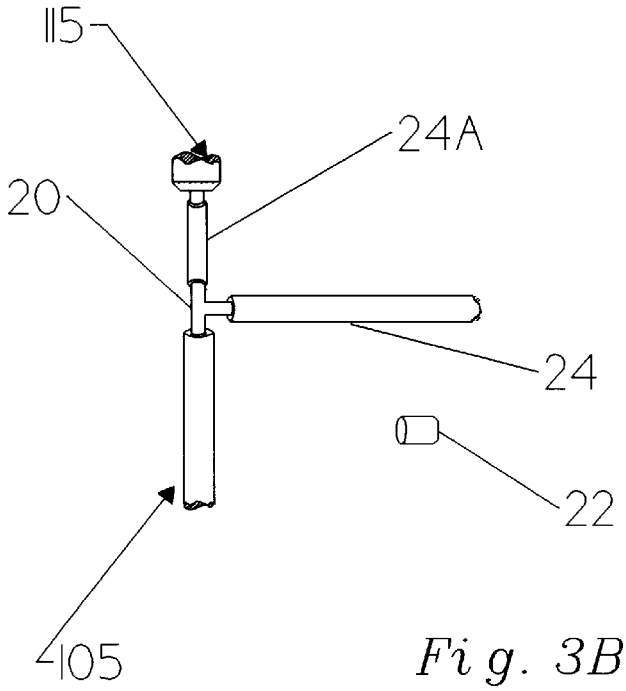
FIG. 3B shows the modification and connection complete, with the addition of a cap to be placed on the third barb when not using the oil removal system.
Figure 4A:
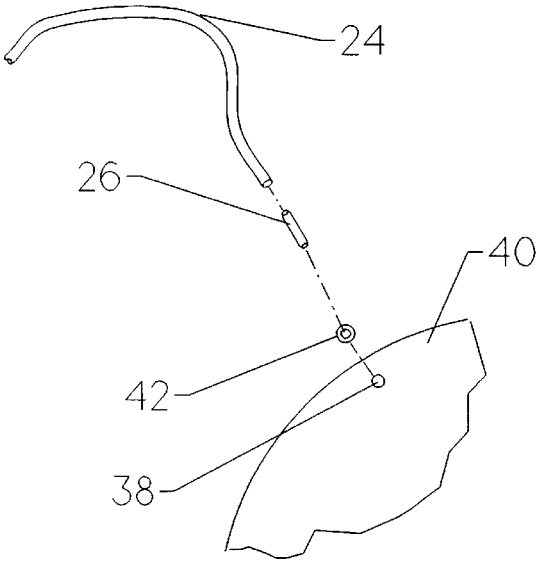
FIG. 4A shows a cutaway section exploded view of the other end of the vacuum conduit as it is to be connected to the reservoir container.
Figure 4B:
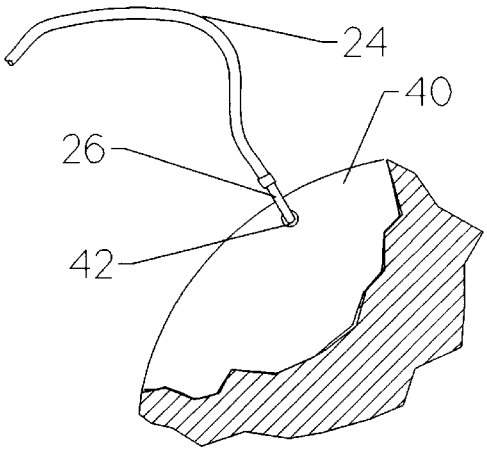
FIG. 4B shows cutaway section of reservoir and the connection made complete to the reservoir container.
Figure 5A:
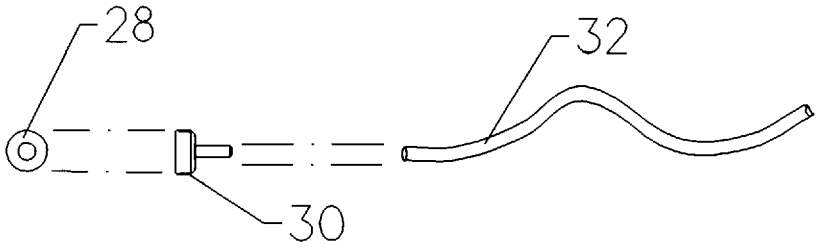
FIG. 5A shows an exploded view of the garden hose style fitting and the hydraulic conduit connection.
Figure 5B:
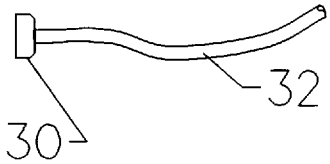
FIG. 5B shows the garden hose style fitting and the hydraulic conduit connection complete.
Figure 5C:
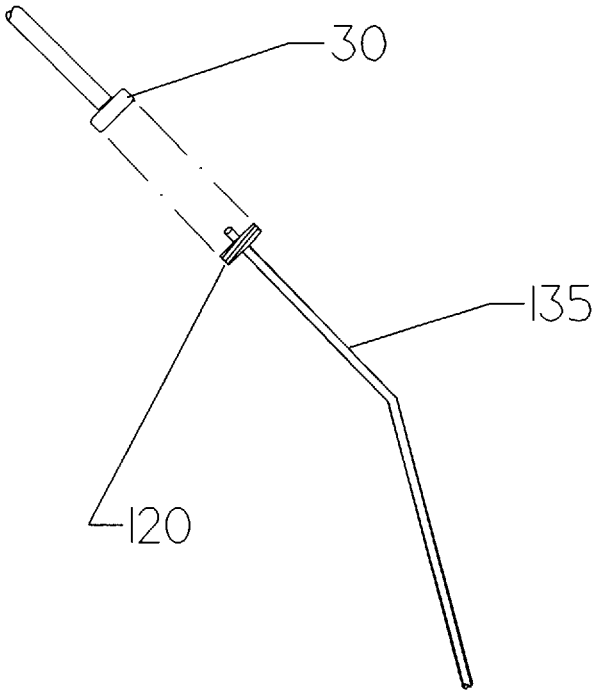
FIG. 5C shows connection made at male threaded dip stick to female threaded hydraulic connection.
Figure 6A:
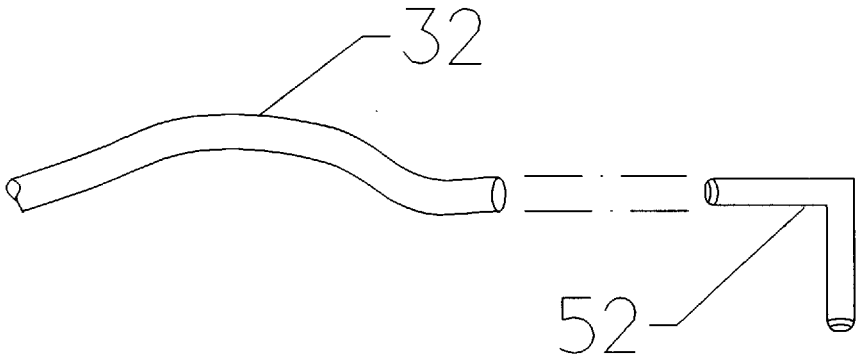
FIG. 6A shows an exploded view of the other end of the hydraulic conduit to be connected to an elbow.
Figure 6B:
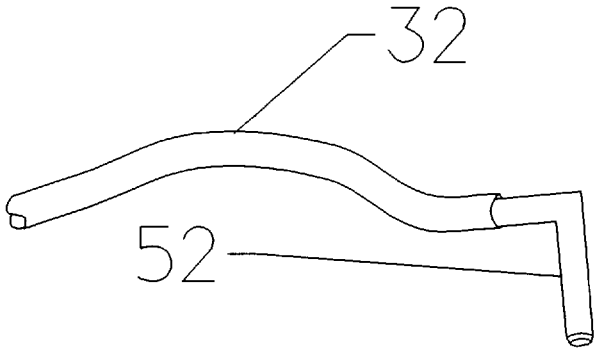
FIG. 6B shows the other end of the hydraulic conduit connected to the elbow complete.
Figure 7A:
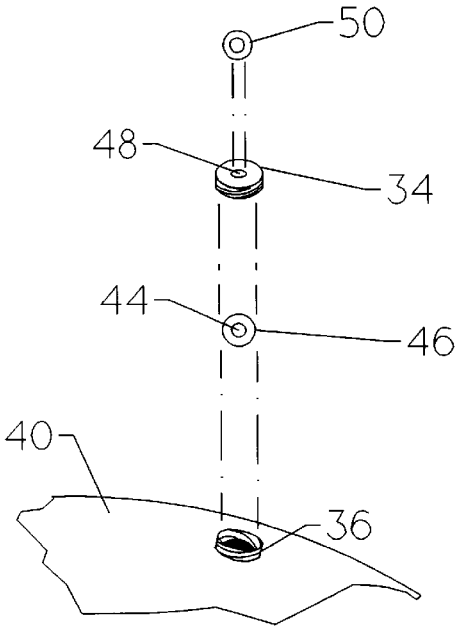
FIG. 7A shows cutaway section of reservoir with an exploded view of the lid of the reservoir with washer and grommet before placement.
Figure 7B:
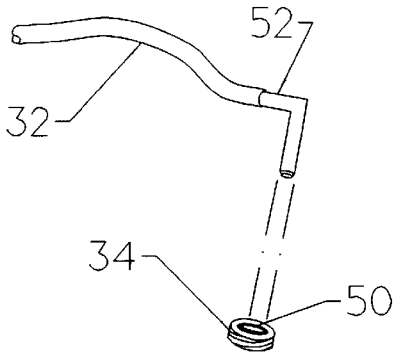
FIG. 7B shows the lid of the reservoir with washer and grommet in place.
Figure 7C:
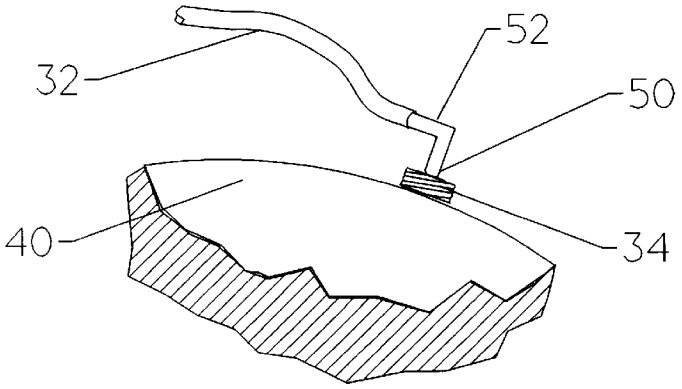
FIG. 7C shows cutaway of reservoir with assembly of the hydraulic conduit to the reservoir complete.

FIG. 5A shows assembly of washer seal for garden hose style connector 28 inserted into garden hose style connector 30. With garden hose style connector 30, the end is inserted into one end of hydraulic conduit 32. FIG. 5B shows the connections of FIG. 5A complete. FIG. 5C shows connections made of garden hose style connector 30 to dipstick tube 120 of inboard internal combustion engine. FIG. 6A shows either end of large two way connector 52 inserted into the other end of hydraulic conduit 32. FIG. 6B shows the assembly of FIG. 6A complete. FIG. 7A shows assembly of washer 46 being placed inside of threaded reservoir lid 34 and then large grommet 50 is inserted into both inlet hole in washer 44 and hole in lid 48. Threaded reservoir lid 34 is then threaded on to threaded opening 36. FIG. 7B shows insertion of large two way connector 52 into grommet 50. FIG. 7C shows assembly of FIGS. 6B, 7A, and 7B completed. FIG. 3A shows one of the opposing ends of three way vacuum conduit connector 20 being inserted as a splice into a vacuum source from an automobile, being connected by insertion of three way vacuum conduit connector 20 into the source line 105 and the other opposing end connected by a two inch in length vacuum splice line 24A, the other end of vacuum splice line 24A is connected by insertion to the vacuum driven device 115 of the automobile, and the third end of three way vacuum conduit connector 20 is inserted into vacuum conduit 24. FIG. 3B shows the assembly of FIG. 3A complete, with a view of cap 22 to be placed on the third barb of connector 20 when the oil changing system is not in use.

Operation—FIG. 1

With the assembly completed as shown in FIG. 1 and described in the paragraph above, the system is ready to operate.

In FIG. 1 start the host engine 100 of the automobile and leave the automobile engine idle as it normally would, (increased RPM of the automobile will not increase the rate of oil flow of the system). In FIG. 1 the system will draw the oil from the engine 130 in the boat being serviced without monitoring.

As the host engine 100 is idling and is creating vacuum which is being drawn through vacuum conduit 24 it is then creating vacuum in reservoir 40. It also is creating vacuum in the hydraulic conduit 32. The vacuum then travels down the dipstick tube 135 of the boat engine 130 to the liquid lubricating oil in the crankcase. The oil travels up the dipstick 135 to hydraulic conduit 32 which deposits crankcase oil into reservoir 40. Reservoir 40 is to be twice that of the capacity of the crankcase being serviced, therefore it does not need to be monitored during operation. Normal time for the system to transfer the oil from crankcase to reservoir 40 is 1 minute or less.

Summary, Ramifications, and Scope

Accordingly, the reader will see that this oil changing system is, not only simple to use and operate, it is cost effective. The simpler a product is to use and maintain by the user, the lower the cost to the user. It is also environmentally friendly to the waters that millions enjoy. Additional advantages in this system are:

- it is easy for anyone to connect the hydraulic conduit to the dipstick for oil removal;
- it is easy for anyone to connect the vacuum conduit to the automobile;
- it allows the system to operate without any additional purchase of any type of electrical pump, drill, or vacuum pump;
- it allows the system to be operated without any laborious hand operated mechanical pumps;
- it allows the system to be operated with the aid of the automobile used to tow the trailer boat;
- it provides a safe means of oil retrieval from a marine inboard crankcase with no spills or dripping from disconnecting from the dipstick when finished with the task of oil changing of the crankcase;
- it provides lowest minimum cost of maintenance of repairs to the oil system due to the fact the system itself has no mechanical moving parts to wear out, which are costly to replace;
- it provides fastest oil removal, due to the constant vacuum pull of 25 Hg from the automobile being used in this system;

Although the description above addresses use of the system for marine inboard engine crankcase oil removal, this should not be construed as limiting the scope of the invention but as merely providing illustration of one of the presently preferred embodiments of this invention. For example, FIG. 5B with an adapter tube to fit on the end of the connector 30 that is small enough to fit into any automobile, heavy equipment, farm implement, over the road truck, or any engine crankcase dipstick, this system can most certainly be used for these purposes. Any and all of these parts of the system mentioned in the previous FIG.2 can be modified in size and shape and volume to fit the needs of removal of many types of liquid from various types of containment.

Thus the scope of the invention should be determined by the appended claims and their legal equivalents, rather than by the examples given.

I claim:

1. Vacuum operated system for removing oil from a crankcase through a dipstick of an internal combustion engine comprising,

- a metal container including cylinder style side walls, flat ferruminate sealed bottom, cone shaped top integral with the side walls, off set from the top a threaded pour spout integral with the metal container, independent of the threaded pour spout a small port hole off set from top,
- a threaded metal lid matched in size to fit said threaded pour spout, having an inlet port hole,
- a washer seal made of flexible material sized to fit inside the threaded metal lid to make a vacuum tight seal having the inlet port hole to match said threaded metal lid,
- a small grommet made of rubber sized to be fitted into the small port hole on top of said metal container,
- a larger grommet made of rubber sized to fit into said threaded metal lid's port hole and the washer seal's port hole,
- a small two-way connector made of rigid material having a barb at opposite ends and sized to fit the small grommet, the small two-way connector is pressed into said small grommet to communicate a vacuum source with said metal container,
- a vacuum conduit made of flexible material of predetermined length and sized to fit said small two-way connector, one end of the vacuum conduit pressed on to said small two-way connector to communicate with said vacuum source,
- a small three-way connector made of rigid material having a barb at each end, the opposing ends of the small three-way connector sized to fit and press in to the vacuum line of an engine and the third end of said small three-way connector sized to fit and press into said vacuum conduit to complete communication between said vacuum source and said metal container,
- a two-way hydraulic connector made of rigid material said connector having a barb at each end sized to fit inside of the larger grommet to communicate with said metal container, a hydraulic conduit made of flexible material of predetermined length and sized to be pressed on to the two-way hydraulic connector allowing communication to said metal container, a dipstick connector made of rigid material sized to fit said two-way hydraulic connector barbed at one end and configured to couple the dipstick of the internal combustion engine being serviced, completing communication from an engine's vacuum source causing negative pressure in said metal container thus drawing oil from the crankcase through the dipstick of the engine being serviced and containing oil in said metal container.

2. Vacuum operated system according to claim 1, wherein the vacuum source is a separate internal combustion engine operating simultaneously, independent of the crankcase having the oil drawn from.

3. Vacuum operated system according to claims 1 or 2, wherein said dipstick connector is adapted to fit various styles of crankcase dipsticks.

* * * * *